US011584567B1

(12) United States Patent
Shi

(10) Patent No.: US 11,584,567 B1
(45) Date of Patent: Feb. 21, 2023

(54) ENCLOSING CUP

(71) Applicant: LPIP, LLC, Naperville, IL (US)

(72) Inventor: Ling Shi, Buffalo Grove, IL (US)

(73) Assignee: LPIP LLC, Naperville, IL (US)

( * ) Notice: Subject to any disclaimer, the term of this patent is extended or adjusted under 35 U.S.C. 154(b) by 301 days.

(21) Appl. No.: 16/874,398

(22) Filed: May 14, 2020

Related U.S. Application Data

(60) Provisional application No. 62/885,169, filed on Aug. 9, 2019, provisional application No. 62/848,460, filed on May 15, 2019.

(51) Int. Cl.
*B65D 25/28* (2006.01)
*A47G 19/22* (2006.01)
*B65D 81/36* (2006.01)

(52) U.S. Cl.
CPC ..... *B65D 25/2811* (2013.01); *A47G 19/2205* (2013.01); *B65D 81/365* (2013.01); *B65D 2525/281* (2013.01)

(58) Field of Classification Search
CPC ..... A63B 21/0602; B65D 81/365; A47G 19/2261; A47G 19/2227
See application file for complete search history.

(56) References Cited

U.S. PATENT DOCUMENTS

D249,438 S 9/1978 Meier
D251,284 S 3/1979 Weaver
D289,694 S 5/1987 Pickett
4,773,640 A * 9/1988 Kolbel ..... A63B 21/0602 482/108
D314,492 S 2/1991 Weller et al.
D319,008 S 8/1991 Leon
D330,857 S 11/1992 Kidd
D332,741 S 1/1993 Turner
D341,774 S 11/1993 Felz
D343,660 S * 1/1994 Hwang ..... D9/535
D346,185 S 4/1994 Francis
D355,591 S 2/1995 Weder
D355,592 S 2/1995 Weder
D355,594 S 2/1995 Weder
D355,596 S 2/1995 Weder
D356,032 S 3/1995 Weder
D357,541 S 4/1995 Neidell
(Continued)

FOREIGN PATENT DOCUMENTS

DE 2915615 A * 10/1980 ..... A63B 21/0602

*Primary Examiner* — Mollie Impink
(74) *Attorney, Agent, or Firm* — The Law Offices of Konrad Sherinian LLC

(57) ABSTRACT

An enclosing cup includes a base, an enclosing container for holding liquid, a handle and a mouth. The enclosing container is supported by the base. The mouth is supported by the enclosing container. The enclosing container incorporates a cavity for containing liquid, and an aperture. The mouth communicates with the cavity via the aperture. Liquid flows into and out of the cavity via the aperture and the mouth. The handle is disposed within the enclosing container. The liquid is disposed around the handle and a user's hand that holds the handle. The handle makes contact with the inner side of the enclosing container at one or more points. The handle allows a user to hold and operate the enclosing cup, while the mouth of the enclosing cup allows the user to drink the liquid out of the enclosing cup.

17 Claims, 3 Drawing Sheets

(56) References Cited

U.S. PATENT DOCUMENTS

D359,655 S 6/1995 Hurst
D370,154 S 5/1996 Gruneisen
D371,934 S 7/1996 Gwirko
D375,258 S 11/1996 Weder
D379,023 S 4/1997 August
D379,149 S 5/1997 Powell
D389,734 S 1/1998 Schultz et al.
D391,155 S 2/1998 Edson et al.
D406,505 S 3/1999 Arroyo
D408,237 S 4/1999 Wysopal
D411,442 S 6/1999 Edson
D416,799 S 11/1999 Adams
6,036,570 A 3/2000 Nadel
D424,375 S 5/2000 D'Arrigo
6,312,364 B1 * 11/2001 Selsam ..... A63B 21/072 482/52
D456,305 S 4/2002 Hopkins
D459,233 S * 6/2002 Young ..... D9/535
D478,480 S 8/2003 Leon
6,814,247 B2 * 11/2004 Matthias ..... A61J 9/00 215/11.1
D511,212 S 11/2005 Whalen
D513,157 S 12/2005 Falt
D524,127 S 7/2006 Lee
D533,459 S * 12/2006 Wagner ..... D9/535
D535,157 S 1/2007 Hoehne
D539,622 S 4/2007 Wysopal
D562,073 S 2/2008 Yeh
D565,288 S 4/2008 Hickman
D570,698 S * 6/2008 Wagner ..... D9/535
D575,164 S 8/2008 Billings
D575,165 S 8/2008 Billings
D580,775 S 11/2008 Harris
D587,968 S 3/2009 Campbell
D589,765 S 4/2009 Zuloff
D609,111 S 2/2010 Bentley et al.
D609,987 S 2/2010 Moman
D621,657 S 8/2010 Quinn
D623,938 S 9/2010 Gordon
D653,443 S 2/2012 Roudybush
D663,575 S 7/2012 Carroll et al.
D678,120 S 3/2013 Reetz et al.
8,485,948 B2 * 7/2013 Cen ..... A63B 21/0608 482/92
D695,005 S 12/2013 Kroupa
D700,846 S 3/2014 Blends
D709,555 S 7/2014 Moore et al.
D713,688 S 9/2014 Thomas
D718,146 S 11/2014 Tussy
D719,033 S 12/2014 Kaddari
D720,926 S 1/2015 Kroupa
D725,392 S 3/2015 Goodwin
D735,050 S 7/2015 Tussy
D743,568 S 11/2015 Almonte
D753,506 S 4/2016 Veletakos
D755,577 S 5/2016 Segal
D761,660 S 7/2016 Giles
D775,895 S 1/2017 Mayberry
D789,748 S 6/2017 Peters et al.
D796,327 S 9/2017 Walbroel et al.
D796,328 S 9/2017 Walbroel et al.
D800,508 S 10/2017 Peters
D807,192 S 1/2018 Haws
D807,694 S 1/2018 Jewett
D821,886 S 7/2018 Paulin et al.
D853,196 S 7/2019 Cramton
D853,792 S 7/2019 Cramton
D856,136 S 8/2019 Marshall
D875,544 S 2/2020 Peters
2003/0189055 A1 * 10/2003 Thinnes ..... A47G 19/2288 220/630
2011/0287903 A1 * 11/2011 Mathews ..... A63B 21/0602 482/93
2012/0199546 A1 8/2012 Dieni
2013/0137556 A1 * 5/2013 Farber ..... A63B 21/072 482/110

* cited by examiner

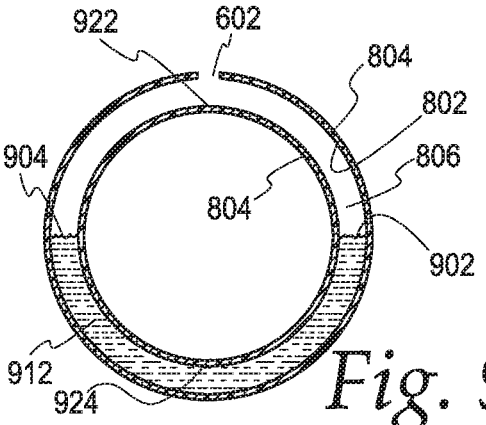
Fig. 9
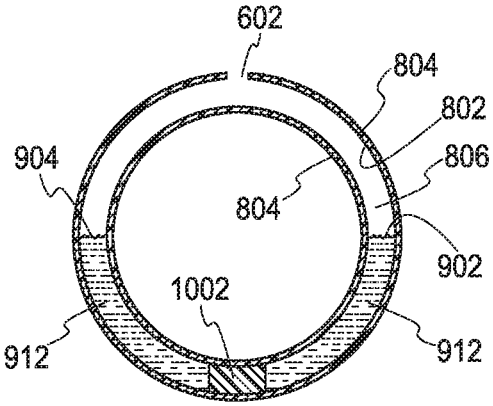
Fig. 10
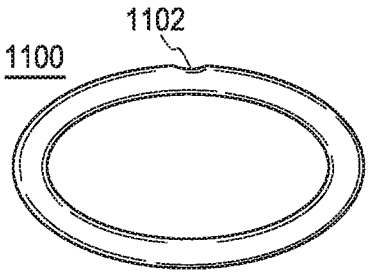
Fig. 11
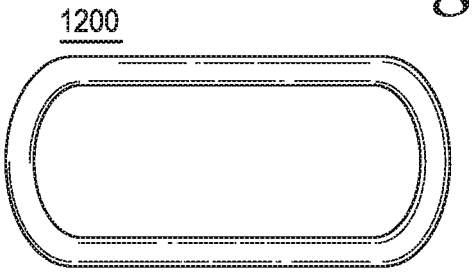
Fig. 12
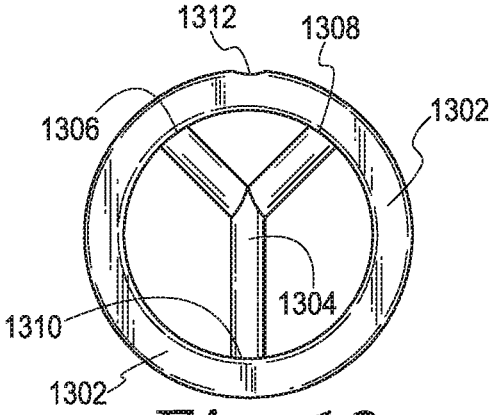
Fig. 13
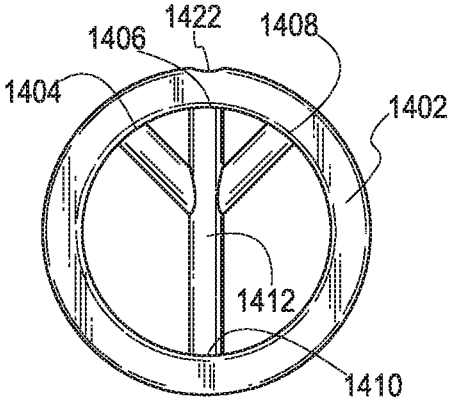
Fig. 14
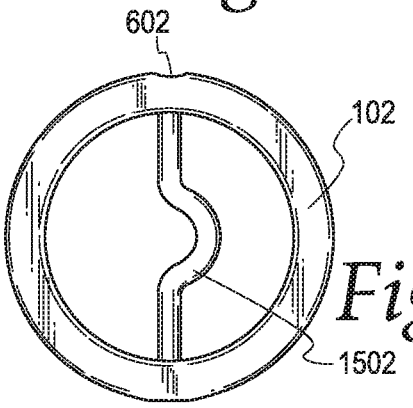
Fig. 15
Fig. 16
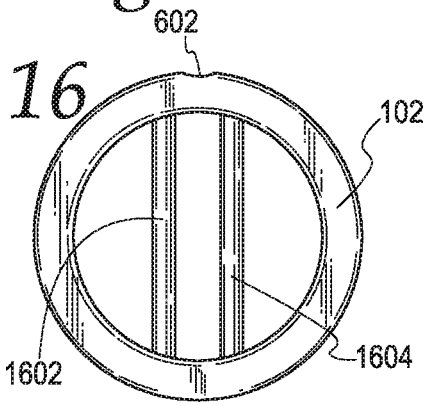

ENCLOSING CUP

CROSS REFERENCE TO RELATED APPLICATIONS

This application claims the benefit and priority of U.S. Provisional Patent Application No. 62/848,460, entitled "ENCLOSING CUP", filed May 15, 2019, which is hereby incorporated by reference in its entirety. This application also claims the benefit and priority of U.S. Provisional Patent Application No. 62/885,169, entitled "ENCLOSING CUP", filed Aug. 9, 2019, which is hereby incorporated by reference in its entirety.

FIELD OF THE DISCLOSURE

The present invention generally relates to a drinkware for containing beverages or liquid foods for drinking or consumption, and more particularly relates to a beverageware with an enclosing container.

DESCRIPTION OF BACKGROUND

Drinkware, such as bear glasses, coffee mugs and water cups, is a common type of devices in people's daily life. These apparatuses are made in different shapes and sizes. However, a conventional drinkware device includes a container part that is adapted to contain and hold beverage or liquid food. A user of the device retrieves the contained liquid (such as water, orange juice, apple juice, bear, etc.) from the container for consumption. When a handle is attached to the container, the user operates the handle to use the drinkware. The handle is on a side of the container. With or without a handle, the container can also be held between the user's fingers and palm. Regardless of the amount of the liquid deposited inside the container, it presents only a single surface that makes contact with the air. For example, whether a glass is ten percent (10%), eighty percent (80%) or one hundred percent (100%) full with water, there is only a single water surface that makes contact with the air.

Accordingly, there is a need fora new drinkware with a liquid container wrapping around the hand of a user when the user holds a handle of the drinkware. The handle is disposed within the enclosing container. When the new drinkware is not fully filled, the liquid inside the container can provide two liquid surfaces making contact with the air. Furthermore, the liquid inside the new drinkware is present around the user's hand holding the handle of the drinkware. In other words, the drinkware's container encloses the user holding hand.

Objects of the Disclosed System, Method, and Apparatus

Accordingly, it is an object of this disclosure to provide a drinkware with an enclosing liquid container.

Another object of this disclosure is to provide a drinkware with an enclosing liquid container and a handle disposed within the enclosing container.

Another object of this disclosure is to provide a drinkware with an enclosing liquid container and a handle contacting the enclosing container at two points.

Another object of this disclosure is to provide a drinkware with an enclosing liquid container and a handle contacting the enclosing container at three points.

Another object of this disclosure is to provide a drinkware with an enclosing liquid container and a handle contacting the enclosing container at four points.

Another object of this disclosure is to provide a drinkware with a circular liquid container and a handle disposed within the enclosing container.

Another object of this disclosure is to provide a drinkware with a circular liquid container and a handle contacting the enclosing container at two points.

Another object of this disclosure is to provide a drinkware with a circular liquid container and a handle contacting the enclosing container at three points.

Another object of this disclosure is to provide a drinkware with a circular liquid container and a handle contacting the enclosing container at four points.

Another object of this disclosure is to provide a drinkware with an oval liquid container and a handle disposed within the enclosing container.

Another object of this disclosure is to provide a drinkware with an oval liquid container and a handle contacting the enclosing container at two points.

Another object of this disclosure is to provide a drinkware with an oval liquid container and a handle contacting the enclosing container at three points.

Another object of this disclosure is to provide a drinkware with an oval liquid container and a handle contacting the enclosing container at four points.

Another object of this disclosure is to provide a drinkware with a rectangular liquid container and a handle disposed within the enclosing container.

Another object of this disclosure is to provide a drinkware with a rectangular liquid container and a handle contacting the enclosing container at two points.

Another object of this disclosure is to provide a drinkware with a rectangular liquid container and a handle contacting the enclosing container at three points.

Another object of this disclosure is to provide a drinkware with a rectangular liquid container and a handle contacting the enclosing container at four points.

Another object of this disclosure is to provide a drinkware with an enclosing liquid container that incorporates an uninterrupted internal cavity for holding liquid.

Another object of this disclosure is to provide a drinkware with an enclosing liquid container that incorporates an interrupted internal cavity for holding liquid.

Other advantages of this disclosure will be clear to a person of ordinary skill in the art. It should be understood, however, that a system, an apparatus or a method could practice the disclosure while not achieving all of the enumerated advantages, and that the protected disclosure is defined by the claims.

SUMMARY OF THE DISCLOSURE

Generally speaking, pursuant to the various embodiments, the present disclosure provides an enclosing drinkware. The enclosing drinkware incorporates a base, an enclosing container resting on the base, and a mouth resting on the container. The base is adapted to be placed on a surface of an object, such as a table and a desk. The container is integrally formed with the base or mounted to the base via welding, screws or other mounting mechanisms. The container incorporates an internal cavity for containing liquid. The container further incorporates an aperture, through which liquid goes into the cavity and comes out of the cavity. The aperture communicates with the cavity enclosed by the mouth. The mouth is integrally formed with the container.

Alternatively, the mouth is mounted to the container via a threaded coupling mechanism, a snap-in mechanism, or another coupling mechanism. The cavity of the enclosing container is either uninterrupted or interrupted. In one embodiment, the container is circular. In another embodiment, the container is oval in shape. In yet another embodiment, the container is rectangular in shape. The rectangular shape can be a square or a rectangle with rounded corners.

Further in accordance with the present teachings is an enclosing cup. The enclosing cup includes a base, and a circular container vertically resting on the base. The circular container includes an aperture and an internal enclosing cavity. The internal enclosing cavity is adapted for containing some amount of liquid. The enclosing cup also includes a mouth vertically resting on the circular container. The mouth includes a top opening and a mouth cavity. The mouth cavity communicates with the internal enclosing cavity through the aperture. The top opening communicates with the mouth cavity. The enclosing cup further includes a handle attached to and enclosed by the circular container. In addition, the enclosing cup includes a joint between the circular container and the base. The circular container rests on the base via the joint. The base supports the joint and the joint supports the circular container. The handle is attached to the circular container at two, three or four different points. The handle, the mouth and the aperture are concentric.

Further in accordance with the present teachings is an enclosing cup having a base, an enclosing container vertically resting on the base. The enclosing container includes an aperture and an internal cavity. The internal cavity is adapted for containing some amount of liquid. The enclosing cup also includes a mouth vertically resting on the enclosing container, and a handle attached to and enclosed by the enclosing container. The mouth includes a top opening and a mouth cavity. The mouth cavity communicates with the internal cavity through the aperture. The top opening communicates with the mouth cavity. The enclosing cup further includes a joint between the enclosing container and the base. The enclosing container rests on the base via the joint. The base supports the joint and the joint supports the enclosing container. The handle is attached to the enclosing container at two, three or four different points. The enclosing container is circular, oval, rectangular or square in shape. The internal cavity is an uninterrupted enclosing cavity or an interrupted cavity. The handle is vertically attached to the enclosing container. The handle, the mouth and the aperture are concentric. In a different implementation, the handle includes two opposite retainers.

BRIEF DESCRIPTION OF THE DRAWINGS

Although the characteristic features of this disclosure will be particularly pointed out in the claims, the invention itself, and the manner in which it may be made and used, may be better understood by referring to the following description taken in connection with the accompanying drawings forming a part hereof, wherein like reference numerals refer to like parts throughout the several views and in which:

FIG. 9 is a cross sectional view of an enclosing container of an enclosing cup in accordance with this disclosure.

FIG. 10 is a cross sectional view of an enclosing container of an enclosing cup in accordance with this disclosure.

FIG. 11 is a front view of an enclosing container of an enclosing cup in accordance with this disclosure.

FIG. 12 is a front view of an enclosing container of an enclosing cup in accordance with this disclosure.

FIG. 13 is a front view of an enclosing container of an enclosing cup in accordance with this disclosure.

FIG. 14 is a front view of an enclosing container of an enclosing cup in accordance with this disclosure.

FIG. 15 is a front side view of a handle of an enclosing cup in accordance with this disclosure.

FIG. 16 is a front side view of a handle of an enclosing cup in accordance with this disclosure.

A person of ordinary skills in the art will appreciate that elements of the figures above are illustrated for simplicity and clarity, and are not necessarily drawn to scale. The dimensions of some elements in the figures may have been exaggerated relative to other elements to help understanding of the present teachings. Furthermore, a particular order in which certain elements, parts, components, modules, steps, actions, events and/or processes are described or illustrated may not be actually required. A person of ordinary skills in the art will appreciate that, for the purpose of simplicity and clarity of illustration, some commonly known and well-understood elements that are useful and/or necessary in a commercially feasible embodiment may not be depicted in order to provide a clear view of various embodiments in accordance with the present teachings.

DETAILED DESCRIPTION

Figure 1:
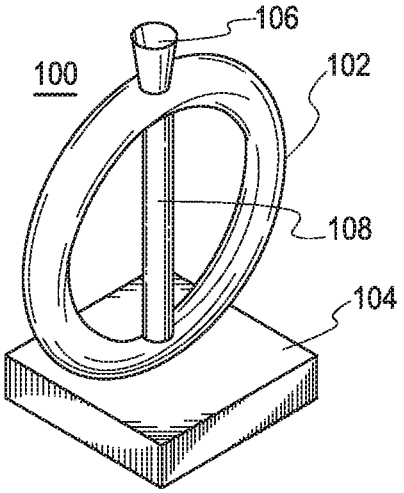
FIG. 1 is a front perspective view of an enclosing cup in accordance with this disclosure.

Turning to the Figures and to FIG. 1 in particular, an illustrative diagram of an enclosing cup is shown and generally indicated at 100. The enclosing cup 100 includes an enclosing container 102 having an internal cavity for containing liquid, a base 104 supporting the enclosing container 102, a mouth 106 vertically resting on the enclosing container 102, and a handle 108 attached to and enclosed by the enclosing container 102. The enclosing container 102 rests on the base 104, which is adapted to stilly stand on a flat surface (such as a table).

In one embodiment, the elements 102-108 are integrally formed. Alternatively, the elements 102-108 are attached to each other using, for example, screws, welding or a threaded coupling mechanism. The welding process varies depending on the material making the enclosing cup 100. As used herein, regardless how the elements 102-108 are formed and coupled together, the mouth 106 is said to be attached to the enclosing container 102; the enclosing container 102 is said to be attached to the base 104; and the handle 108 is said to be attached to the enclosing container 102. In the illustrative embodiment, the handle 108 is in a vertical or substantially vertical orientation. As used herein, the handle 108 is said to be a vertical handle. The spaces between the handle 108 and the enclosing container 102 are adapted to receive a user's hand and fingers.

Extending away from the enclosing container 102, the mouth 106 has a top opening at the top of it. The mouth 106 tapers downward. The bottom of the mouth 106 is open as well. The bottom opening of the mouth 106 merges and communicates with an aperture in the enclosing container 102. The aperture in the enclosing container 102 communicates with the internal cavity of the enclosing container 102. The diameter of the top opening of the mouth 106 is larger than that of the aperture. The cavity (also referred to herein as the mouth cavity) formed by the mouse 106 communicates with the internal cavity of the enclosing container 102, and the top opening of the mouth 106. Therefore, liquid, such as water, orange juice, beers, etc., can flow into the internal cavity of the enclosing container 102. It is also said that the liquid flows into the enclosing container 102. When the liquid is to be consumed, a user holds the handle 108 and tilts the enclosing mug 102 for the liquid to flow out of the enclosing container 102 and into the user's mouth through the mouth 106.

The enclosing cup 100 is made of made of, for example, glass, metal (such as copper), acrylic, or other types of materials. Furthermore, the elements 102-108 can be made of different types materials. For instance, the elements 102, 106 and 108 can be made of acrylic while the base 104 is made of wood. In such a case, the enclosing container 102 is affixed to the base 104.

Figure 2:
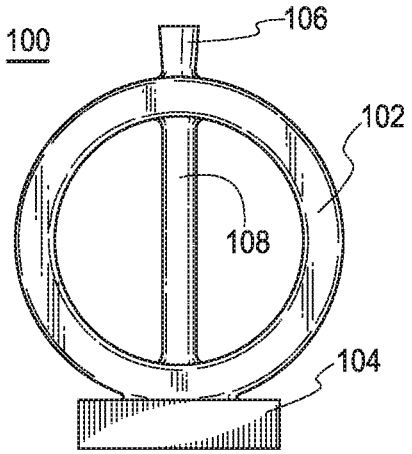
FIG. 2 is a front view of an enclosing cup in accordance with this disclosure.
Figure 3:
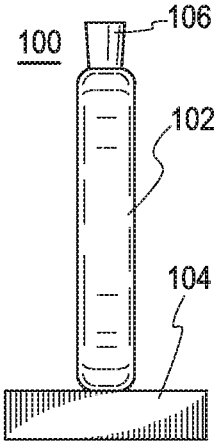
FIG. 3 is a left side view of an enclosing cup in accordance with this disclosure.
Figure 4:
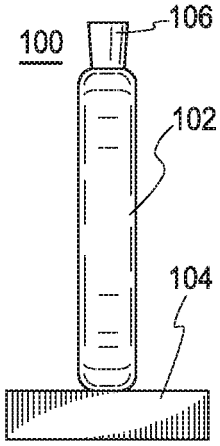
FIG. 4 is a right side view of an enclosing cup in accordance with this disclosure.
Figure 5:
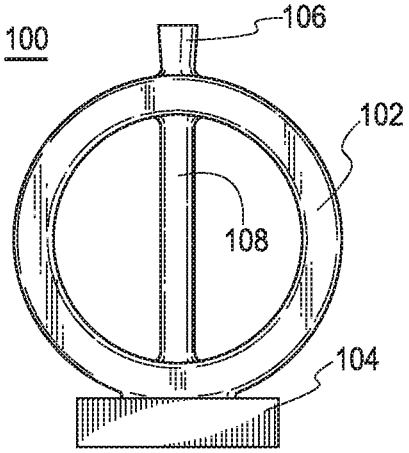
FIG. 5 is a rear view of an enclosing cup in accordance with this disclosure.
Figure 6:
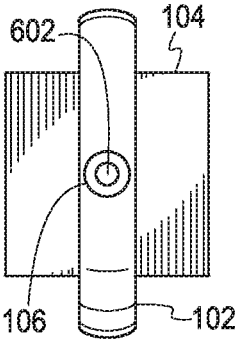
FIG. 6 is a top view of an enclosing cup in accordance with this disclosure.
Figure 7:
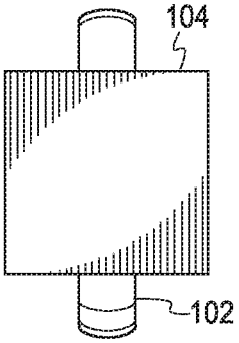
FIG. 7 is a bottom view of an enclosing cup in accordance with this disclosure.

A front view of the enclosing cup 100 is shown in FIG. 2. FIG. 3 is a left side view of the enclosing cup 100, while FIG. 4 is a right side view of the enclosing cup 100. A rear view of the enclosing cup 100 is shown in FIG. 5. A top view of the enclosing cup 100 is shown in FIG. 6. The aperture of the enclosing container 102 is indicated at 602. In the illustrative embodiment, the handle 108, the aperture 602 and the mouth 106 are concentric or approximately concentric. In either case, the handle 108, the aperture 602 and the mouth 106 are said to be concentric herein. FIG. 7 shows a bottom view of the enclosing cup 100.

Figure 21:
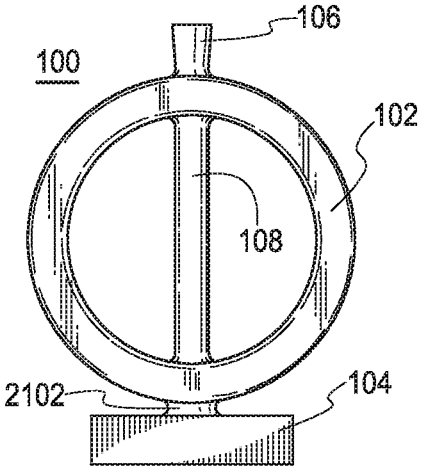
FIG. 21 is a front view of an enclosing cup in accordance with this disclosure.

The joint between the enclosing container 102 and the base 104 is a transition between them. A joint is shown in FIG. 21 with more separation. Referring to FIG. 21, the joint (also referred to herein as a leg) is indicated at 2102. Without deviating from the present teachings, the leg 2102 can be shorter or longer (such as 20 millimeter). As used herein, the joint 2102 is said to join the enclosing container 102 and the base 104; the joint 2102 supports the enclosing container 102; the base 104 supports the joint 2102; the enclosing container 102 rests on the joint 2102; and the joint 2102 rests on the base 104. It is also said that the enclosing container 102 vertically rests on and is supported by the base 104.

Figure 8:
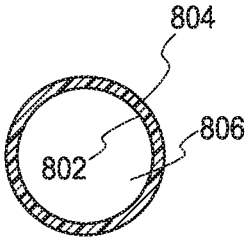
FIG. 8 is a cross sectional view of an enclosing container of an enclosing cup in accordance with this disclosure.

Referring to FIG. 8, a horizontal cross-sectional view of the enclosing container 102 is shown. The cavity of the enclosing container 102 is indicated at 806; the cavity surface (also referred to herein as the internal surface of the enclosing container 102 is indicated at 802; and the external surface of the enclosing container 102 is indicated at 804.

Referring now to FIG. 9, a vertical cross-sectional view of the enclosing cup 100 with some amount of liquid 912 disposed inside the cavity 806 of the enclosing container 102 is shown. The liquid 912 makes contact with the air at two different surfaces 902 and 904. When more liquid 912 is filled inside the cavity 806, the two different surfaces 902 and 904 rise and eventually merge into a single surface. In other words, when the liquid 912 is above the upper bottom point 922 of the internal cavity 806, the two different surfaces 902 and 904 merge into a single one. Furthermore, when the amount of the liquid 912 is very small, the two different surfaces 902 and 904 fall and eventually merge into a single surface as well. In other words, when the liquid 921 is below the lower top point 924, the two different surfaces 902 and 904 merge into a single liquid surface. The cavity 806 extends along the enclosing container 102 in 360 degrees. The cavity 806 is thus termed herein as an enclosing cavity.

Turning to FIG. 10, a vertical cross-sectional view of the enclosing cup 100 with some amount of liquid 912 disposed inside the cavity 806 of the enclosing container 102 is shown. In this alternate embodiment, a separator 1002 is included. The separator 1002 can be integrally formed with the enclosing container 102 or otherwise disposed therein. As used herein, the separator 1002 is said to be attached to the enclosing container 102. The separator 1002 separates the liquid 912 into two separate parts when the liquid level is below the lower top 924 point of the inside circumference. As the level of liquid 912 is above the upper bottom point 922 of the inside circumference, the two parts 912 merge. The cavity 806 shown in FIG. 10 is termed herein as an interrupted cavity, while the cavity 806 shown in FIG. 9 is also termed herein as an uninterrupted enclosing cavity because it extends along the enclosing container 102 in 360° degrees. In either case, the cavity 806 is a single cavity. The cavity 806 is not an enclosing cavity in the illustrative embodiment shown in FIG. 10.

In one implementation, the enclosing container 102 is circular or substantially circular. In such cases, the enclosing container 102 is said to be a circular container. Alternatively, the enclosing container 102 can be in an oval shape shown in FIG. 11 and indicated at 1100, or a rectangular (or square) shape shown in FIG. 12 and indicated at 1200. The enclosing containers 1100 further incorporates an aperture 1102 communicating with the internal cavity of the enclosing containers 1100. The enclosing containers 1100 and 1200 provide more space for a user's hand and fingers to grab the handle disposed within the inside circumference of the respective enclosing containers.

In the illustrative embodiment shown in FIG. 1, the handle 108 makes contact with the enclosing container 102 at two different points on the inside of the enclosing container 102 and the two ends of the handle 108. The handle 108 is said to be enclosed within the enclosing container 102. FIGS. 13 and 14 illustrate alternate embodiments of the handle 108 and the enclosing container 102. Turning first to FIG. 13, the enclosing container is indicated 1302 and the handle is indicated at 1304. The handle 1304 is attached to the enclosing container 1302 at three different points 1306, 1308 and 1310. The contact 1310 is at the lower end of the handle 1304 while the contacts 1306-1308 are at the other end of the handle 1304. The enclosing container 1302 further incorporates an aperture indicated at 1312. The aperture 1312 communicates with the internal cavity of the enclosing container 1302. In the illustrative embodiment, the handle 1304 and the aperture 1312 are concentric or approximately concentric. In either case, the handle 1304 and the aperture 1302 are said to be concentric herein.

Turning now to FIG. 14, the enclosing container is indicated 1402 and the handle is indicated at 1412. The handle 1412 is attached to the enclosing container 1402 at four different points 1404, 1406, 1408 and 1410. The contact 1410 is at the lower end of the handle 1412 while the contacts 1404-1410 are at the other end of the handle 1412. The enclosing container 1402 further incorporates an aperture indicated at 1422. The aperture 1422 communicates with the internal cavity of the enclosing container 1402. In the illustrative embodiment, the handle 1412 and the aperture 1422 are concentric or approximately concentric. In either case, the handle 1412 and the aperture 1422 are said to be concentric herein. Moreover, in the illustrative embodiments, the enclosing containers 102, 1100, 1200, 1302 and 1402 each form an enclosure of 360°.

Obviously, many additional modifications and variations of the present disclosure are possible in light of the above teachings. Thus, it is to be understood that, within the scope of the appended claims, the disclosure may be practiced otherwise than is specifically described above. For example, the handle 108 is attached to the enclosing container 102 at only one end of the handle 108. In such a case, the handle 108 makes contact with the enclosing container 102 at only one end. As another example, the handle 1412 is attached to the enclosing container 1402 at four points at the top end. As yet another example, the handle 108, the handle 1304 and/or the handle 1412 makes the contact with the respective enclosing container at more than one point at the lower end.

Furthermore, the handle 108, and the mouth 106 and the aperture 602 do not have to be concentric or approximately concentric. For example, in one embodiment, the handle 108 is replaced by the handle 1502, shown in FIG. 15. The handle 1502 is not concentric with the aperture 602. The curved portion of the 1502 can be visible or invisible in side views (right and left side views) of the enclosing container 102 without deviating from the present teachings. In another embodiment, the handle 108 is replaced by a handle with more than one element. As shown in FIG. 16, the handle includes two separate and disjoint elements 1602 and 1604. The elements 1602-1604 each are enclosed within and attached to the enclosing container 102.

Figure 17:
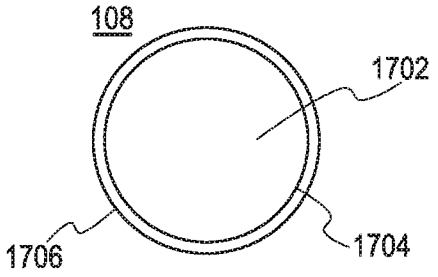
FIG. 17 is a cross-sectional view of a handle of an enclosing cup in accordance with this disclosure.
Figure 18:
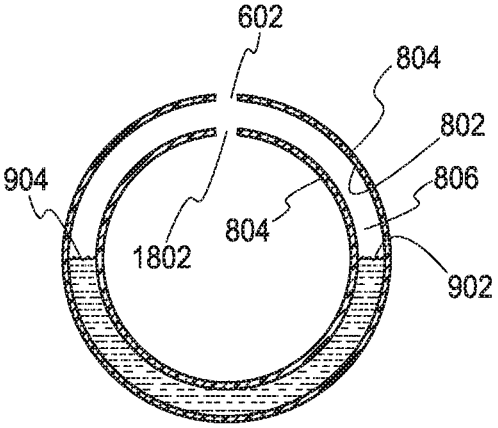
FIG. 18 is a cross sectional view of an enclosing container of an enclosing cup in accordance with this disclosure.

In a further implementation, the handle incorporates an internal cavity for containing additional liquid. A cross-sectional view of the handle 108 is shown in FIG. 17. The handle 108 includes an internal cavity 1702, an internal surface 1704 and an external surface 1706. The internal surface 1704 encloses the internal cavity 1702. The internal cavity 1702 communicates with the cavity 806 of the enclosing container 102 via an aperture 1802 aperture of the enclosing container 102 shown in FIG. 18. FIG. 18 is a vertical cross-sectional view of the enclosing container 102 with some amount of liquid 912 disposed inside the cavity 806 of the enclosing container 102. When liquid is poured into the mouth 106, it flows into the container 102 through the aperture 602, and into the internal cavity 1702 through apertures 602 and then the aperture 1702. The aperture 1802 is not present in FIG. 9 or FIG. 10. Accordingly, the handle 108 of each of the embodiments shown in FIGS. 9 and 10 does not include an internal cavity that communicates with the cavity 806 for containing some amount of liquid.

Figure 19:
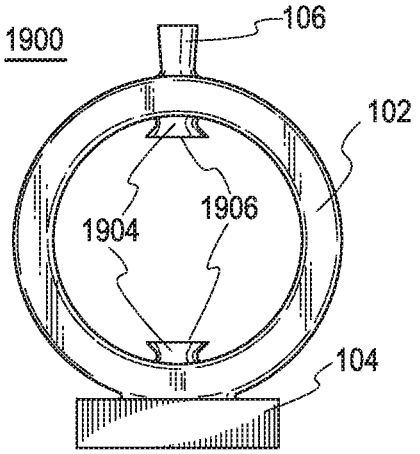
FIG. 19 is a front view of an enclosing cup in accordance with this disclosure.
Figure 20:
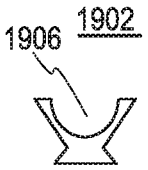
FIG. 20 is a cross-sectional view of a retainer of an enclosing cup in accordance with this disclosure.

In an alternate implementation, the handle 108 includes two separate parts as shown in FIG. 19. Turning to FIG. 19, a front view of an enclosing cup in accordance with this disclosure is shown and generally indicated at 1900. With the enclosing cup 1900, the handle includes two opposite retainers 1902 and 1904. The retainers 1902-1904 each incorporate a recess 1906. The recesses 1906 are adapted to receive, for example, the two ends of an American football. A user can deflate the football to make it easy to bend; place the two ends of the football into the two recesses 1906 respectively; and then inflate the football to make the football firmly engaged with the cup 1900. Thereafter, the user can use the enclosing cup 1900 by holding the football locked into the recesses 1906. A cross-sectional view of the retainer 1902 (or 1904) is shown in FIG. 20. As used herein, the two opposite retainers 1902 and 1904 are collectively referred to herein as the handle of the enclosing cup 1900.

The foregoing description of the disclosure has been presented for purposes of illustration and description, and is not intended to be exhaustive or to limit the disclosure to the precise form disclosed. The description was selected to best explain the principles of the present teachings and practical application of these principles to enable others skilled in the art to best utilize the disclosure in various embodiments and various modifications as are suited to the particular use contemplated. It should be recognized that the words "a" or "an" are intended to include both the singular and the plural. Conversely, any reference to plural elements shall, where appropriate, include the singular.

It is intended that the scope of the disclosure not be limited by the specification, but be defined by the claims set forth below. In addition, although narrow claims may be presented below, it should be recognized that the scope of this invention is much broader than presented by the claim(s). It is intended that broader claims will be submitted in one or more applications that claim the benefit of priority from this application. Insofar as the description above and the accompanying drawings disclose additional subject matter that is not within the scope of the claim or claims below, the additional inventions are not dedicated to the public and the right to file one or more applications to claim such additional inventions is reserved.

What is claimed is:

1. An enclosing cup comprising:

i) a base;

ii) a circular container vertically resting on said base, said circular container having an aperture and an internal enclosing cavity, said internal enclosing cavity adapted for containing some amount of liquid;

iii) a mouth vertically resting on said circular container and having a top opening and a mouth cavity, said mouth cavity communicating with said internal enclosing cavity through said aperture, said top opening communicating with said mouth cavity, said mouth tapering downward, said top opening having a larger diameter than said aperture; and iv) a handle attached to and enclosed by said circular container, said handle not including an internal cavity communicating with said internal enclosing cavity wherein the enclosing cup further comprises a joint between said circular container and said base, wherein said circular container rests on said base via said joint and wherein said base supports said joint and said joint supports said circular container.

2. The enclosing cup of claim 1 wherein said handle is attached to said circular container at two different points.

3. The enclosing cup of claim 1 wherein said handle is attached to said circular container at three or four different points.

4. The enclosing cup of claim 1 wherein said handle, said mouth and said aperture are concentric.

5. The enclosing cup of claim 1 wherein said handle is attached to said circular container at two, three or four different points.

6. The enclosing cup of claim 5 wherein said handle, said mouth and said aperture are concentric.

7. An enclosing cup comprising:

i) a base;

ii) an enclosing container vertically resting on said base, said enclosing container having an aperture and an internal cavity, said internal cavity adapted for containing some amount of liquid;

iii) a mouth vertically resting on said enclosing container and having a top opening and a mouth cavity, said mouth cavity communicating with said internal cavity through said aperture, said top opening communicating with said mouth cavity, said mouth tapering downward, said top opening having a larger diameter than said aperture; and iv) a handle attached to and enclosed by said enclosing container, said handle not including an internal cavity communicating with said internal enclosing cavity wherein the enclosing cup further comprises a joint between said enclosing container and said base, wherein said enclosing container rests on said base via said joint and wherein said base supports said joint and said joint supports said enclosing container.

8. The enclosing cup of claim 7 wherein said handle is attached to said enclosing container at two, three or four different points.

9. The enclosing cup of claim 8 wherein said enclosing container is circular, oval, rectangular or square in shape.

10. The enclosing cup of claim 9 wherein said internal cavity is an uninterrupted enclosing cavity or an interrupted cavity.

11. The enclosing cup of claim 10 wherein said handle is vertically attached to said enclosing container.

12. The enclosing cup of claim 11 wherein said handle, said mouth and said aperture are concentric.

13. The enclosing cup of claim 10 wherein said handle includes two opposite retainers.

14. An enclosing cup comprising:

i) a base;

ii) an enclosing container vertically resting on said base, said enclosing container having an aperture and an internal cavity, said internal cavity adapted for containing some amount of liquid;

iii) a mouth vertically resting on said enclosing container and having a top opening and a mouth cavity, wherein:

1) said mouth tapers downward;

2) said top opening has a larger diameter than said aperture;

3) said mouth cavity communicates with said internal cavity through said aperture; and 4) said top opening communicates with said mouth cavity;

iv) a handle attached to and enclosed by said enclosing container wherein the enclosing cup further comprises a joint between said enclosing container and said base, wherein said enclosing container rests on said base via said joint and wherein said base supports said joint and said joint supports said enclosing container.

15. The enclosing cup of claim 14 wherein said enclosing container is circular, oval, rectangular or square in shape.

16. The enclosing cup of claim 15 wherein said internal cavity is an uninterrupted enclosing cavity or an interrupted cavity.

17. The enclosing cup of claim 14 wherein said handle, said mouth and said aperture are concentric.

* * * * *